US006543792B1

(12) United States Patent
Maurice

(10) Patent No.: US 6,543,792 B1
(45) Date of Patent: Apr. 8, 2003

(54) IN-LINE SKATE SUSPENSION FOR SHOCK ENERGY STORAGE AND RECOVERY

(75) Inventor: Daniel George Maurice, Bourne, MA (US)

(73) Assignee: Android Laboratories, North Falmouth, MA (US)

( * ) Notice: Subject to any disclaimer, the term of this patent is extended or adjusted under 35 U.S.C. 154(b) by 0 days.

(21) Appl. No.: 09/329,623

(22) Filed: Jun. 10, 1999

Related U.S. Application Data

(60) Provisional application No. 60/090,754, filed on Jun. 26, 1998.

(51) Int. Cl.[7] ..... A63C 1/24; A63C 17/02

(52) U.S. Cl. ..... 280/11.225; 280/11.28

(58) Field of Search ..... 280/11.27, 11.28, 280/11.223, 11.225, 87.041, 11.224, 11.19, 11.221, 11.231, 11.233, 842, 87.042

(56) References Cited

U.S. PATENT DOCUMENTS

| | | | | |
|---|---|---|---|---|
| 332,277 | A | | 12/1885 | Mulvin |
| 334,281 | A | | 1/1886 | Puncher |
| 341,999 | A | | 5/1886 | Davis |
| 345,781 | A | | 7/1886 | Havens |
| 865,441 | A | | 9/1907 | Slocum |
| 2,195,348 | A | | 3/1940 | Wisley |
| 2,400,535 | A | | 5/1946 | Celmer |
| 2,644,692 | A | | 7/1953 | Kahlert |
| 2,797,926 | A | | 7/1957 | Swensson |
| 3,339,936 | A | * | 9/1967 | Hamlin ..... 280/11.2 |
| 4,402,521 | A | * | 9/1983 | Mongeon ..... 280/11.23 |
| 4,700,958 | A | | 10/1987 | Volpato |
| 5,127,672 | A | | 7/1992 | Horibata |
| 5,405,156 | A | | 4/1995 | Gonella |
| 5,503,413 | A | | 4/1996 | Belogour |
| 5,551,713 | A | * | 9/1996 | Alexander ..... 280/11.19 |
| 5,842,706 | A | * | 12/1998 | Chang ..... 280/11.28 |
| 5,890,724 | A | * | 4/1999 | Gignoux et al. ..... 280/11.28 |
| 5,918,889 | A | * | 7/1999 | Tai ..... 280/11.22 |
| 6,029,984 | A | * | 2/2000 | Pivotto ..... 280/11.28 |
| 6,053,512 | A | * | 4/2000 | Chang ..... 280/11.22 |
| 6,209,889 | B1 | * | 4/2001 | Alfieri et al. ..... 280/11.224 |
| 6,213,479 | B1 | * | 4/2001 | Cochimin ..... 280/7.1 |

FOREIGN PATENT DOCUMENTS

| | | |
|---|---|---|
| WO | WO93/12847 | 7/1993 |

* cited by examiner

*Primary Examiner*—Brian L. Johnson
*Assistant Examiner*—G B Klebe
(74) *Attorney, Agent, or Firm*—Gerald T. Bodner; Robert A. Seemann

(57) ABSTRACT

A pair of shock elements mounted on the wheel bearing frame of an in-line skate and attached to a foot platform are configured so that the attachment points of the shock elements to the platform which move in a Z direction are prevented from moving in an X or Y direction from each other and from movement in a Y direction measured from a plane parallel to the plane of rotation of the wheels and from movement in a X direction from a line parallel to the axis of one of the skate wheels.

24 Claims, 9 Drawing Sheets

IN-LINE SKATE SUSPENSION FOR SHOCK ENERGY STORAGE AND RECOVERY

This application claims the benefit of U.S. Provisional Application No. 60/090,754, filed Jun. 26, 1998.

BACKGROUND OF THE INVENTION

1. Field of the Invention

The invention pertains to in-line skates, more specifically to a shock absorber system for in-line skates including roller and blade supported skates, which controls roll, pitch, yaw, and provides shock energy storage and recovery.

2. Description of the Prior Art

The prior art is replete with patents describing skate shock absorber systems. U.S. Pat. No. 332,277 patented Dec. 15, 1885 by T. Mulvin describes a rubber block between the skate heel support platform and the axle frame for the wheels. A second rubber block is clamped to the heel platform to compress the first block in place which in elastic compression supports the heel and imparts a free tilting or oscillating motion between the wheel's axes and the platform. U.S. Pat. No. 334,281 patented Jan. 12, 1886 by Punches, describes a foot support platform mounted on a front wheeled truck by a first vertical screw through a first rubber doughnut shock absorber spacer between the platform and the truck.

The platform is also mounted on a rear wheeled truck by a second vertical screw through a second rubber doughnut shock absorber spacer between the platform heel area and the rear truck.

The first truck and the second truck each can pivot on the screws, and are connected together by a flat spring in the vertical plane, so that lateral movement of the center of the spring causes the front and back trucks to pivot on the screws. The doughnuts permit the platform to rock or lean, that is, to roll on the longitudinal axis when the rider leans into a turn, and to pitch on a horizontal central axis. A yoke attached to the platform and to the flat vertical spring deflects the spring laterally at the middle of the spring when the platform rolls on the longitudinal axis of the skate. The deflected spring pivots the trucks so that the skate yaws from the longitudinal axis of the skate on a vertical axis of the skate as wheels travel an arc that complements the lean.

U.S. Pat. No. 345,781 patented Jul. 20, 1886 by J. G. Havens describes a foot support platform pivotally mounted by a pair of spring-loaded vertical shafts on the wheel bearing frame so that when the skate is describing a curve, the platform can be made to roll, or be thrown out of level from the skate wheel axes to one side or the other, as the curve of skate travel is to the right or left.

U.S. Pat. No. 865,441 patented Sep. 10, 1907 by G. S. Slocum, describes a spring foot plate mounted on forward and rear saddles each mounting a roller carrying truck that turns when pressure is applied to either side of the foot plate causing the rollers to run on a curve toward that side upon which the pressure is brought.

U.S. Pat. No. 2,797,926 patented Jul. 2, 1957 by C. E. Swensson describes a foot support platform rockably mounted on the wheel bearing frame by a ball and socket on a rubber shock absorber.

U.S. Pat. No. 5,405,156 patented Apr. 11, 1995 by M. Gonella, describes a foot support platform mounted on front and rear wheeled trucks of an in-line wheel skate by springs at the distal first ends of the trucks, the second ends of the trucks being independently pivotally attached to the bottom of the platform at the middle of the platform so that the platform is free to pitch about a generally central horizontal transverse axis of the skate. The degree of pitch is controlled by rubber cushioned stops between the platform and each truck which are slidably mounted on the platform for sliding horizontally lengthwise toward and away from the pivotal mounting of the second ends of the trucks.

U.S. Pat. No. 5,503,413 patented Apr. 2, 1996 by P. Belogour, describes an in-line wheel skate foot support platform pivotally mounted at the toe end of the platform on a first end of the wheel truck of the skate by an axis that is transverse to the longitudinal axis of the skate. The heel end of the platform is mounted on the truck by a vertical spring loaded shock absorber that is pivotally attached to the second end of the truck so that the platform can pitch on the toe end pivotal axis as the heel oscillates.

SUMMARY OF THE INVENTION

It is one object of the invention to provide an in-line skate in which the platform adapted for attachment of the skate to the foot is protected from wheel vibration.

It is another object of the invention to provide an in-line skate which has energy recovery shock absorber means connecting the platform to the wheels.

It is another object of the invention to provide an in-line skate which has energy recovery shock absorber means connecting the platform to the wheels for resilient extension of the platform from the axis of the wheels.

It is another object of the invention to provide an in-line skate having a plurality of in-line wheels, which has shock absorber means connecting the platform to the in-line wheels for resilient extension of the platform from the axis of the wheels wherein the platform does not roll, or yaw from the axes and plane of rotation of the wheels.

Other objects and advantages will be apparent to one reading the ensuing description of the invention.

An in-line skate includes a platform adapted for attachment of the skate to a foot, a frame, a plurality of in-line wheels mounted on the frame, a first shock element mounted on the frame and on the platform, a second shock element mounted on the frame and on the platform spaced from the first shock element, the shock elements being configured so that the platform is moved in a Z direction by each shock element.

Preferably the platform is configured to change pitch between the first shock element and the second shock element.

In another arrangement the platform is flexible in pitch, and stiffened against yaw and roll from a plane parallel to the plane of rotation of the plurality of wheels.

In another arrangement the platform is flexible in pitch, and is rigid against yaw and roll from a plane parallel to the plane of rotation of the plurality of wheels.

Preferably the shock elements at their mountings to the platform are prevented from moving in an X or Y direction from each other, from moving in a Y direction from a plane parallel to the plane of rotation of the plurality of in-line wheels, and from moving in the X direction from a line parallel to the axis of rotation of one of the wheels of the plurality of in-line wheels.

In another arrangement the shock elements at their mountings to the frame are prevented from moving in an X or Y direction from each other, from moving in a Y direction from a plane parallel to the plane of rotation of the plurality of in-line wheels, and from moving in the X direction from a line parallel to the axis of rotation of one of the wheels of the plurality of in-line wheels.

In another arrangement according to the invention an in-line skate includes a platform adapted for attachment of the skate to a foot, a frame, a plurality of in-line wheels mounted on the frame, having a ground contact line, a pair of shock elements mounted spaced apart on the frame and mounted on the platform, so that if the wheels are held fixed to the ground, the shock elements are configured so that the platform moves in a vertical Z direction at each shock element and each shock element is prevented from moving in a lateral Y direction and in a toe to heel X direction from each other.

Preferably each shock element is prevented from moving in a lateral Y direction from a plane parallel to the plane of rotation of the plurality of in-line wheels, and from moving in the toe to heel X direction measured from a line parallel to the axis of rotation of one of the wheels of the plurality of in-line wheels.

In another arrangement an in-line skate includes a frame, a plurality of in-line wheels mounted on the frame, having a ground contact line, a first shock element mounted on the frame, comprising first means for attaching the first shock element to a platform adapted for attachment of the skate to a foot, a second shock element mounted on the frame, comprising second means for attaching the second shock element to the platform, the first shock element and the second shock element being configured so that the first and the second means for attaching move in a Z direction, are prevented from moving in a Y direction from a plane parallel to the plane of rotation of the plurality of in-line wheels, and from moving in a X direction from a line parallel to the axis of rotation of one of the wheels of the plurality of in-line wheels.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
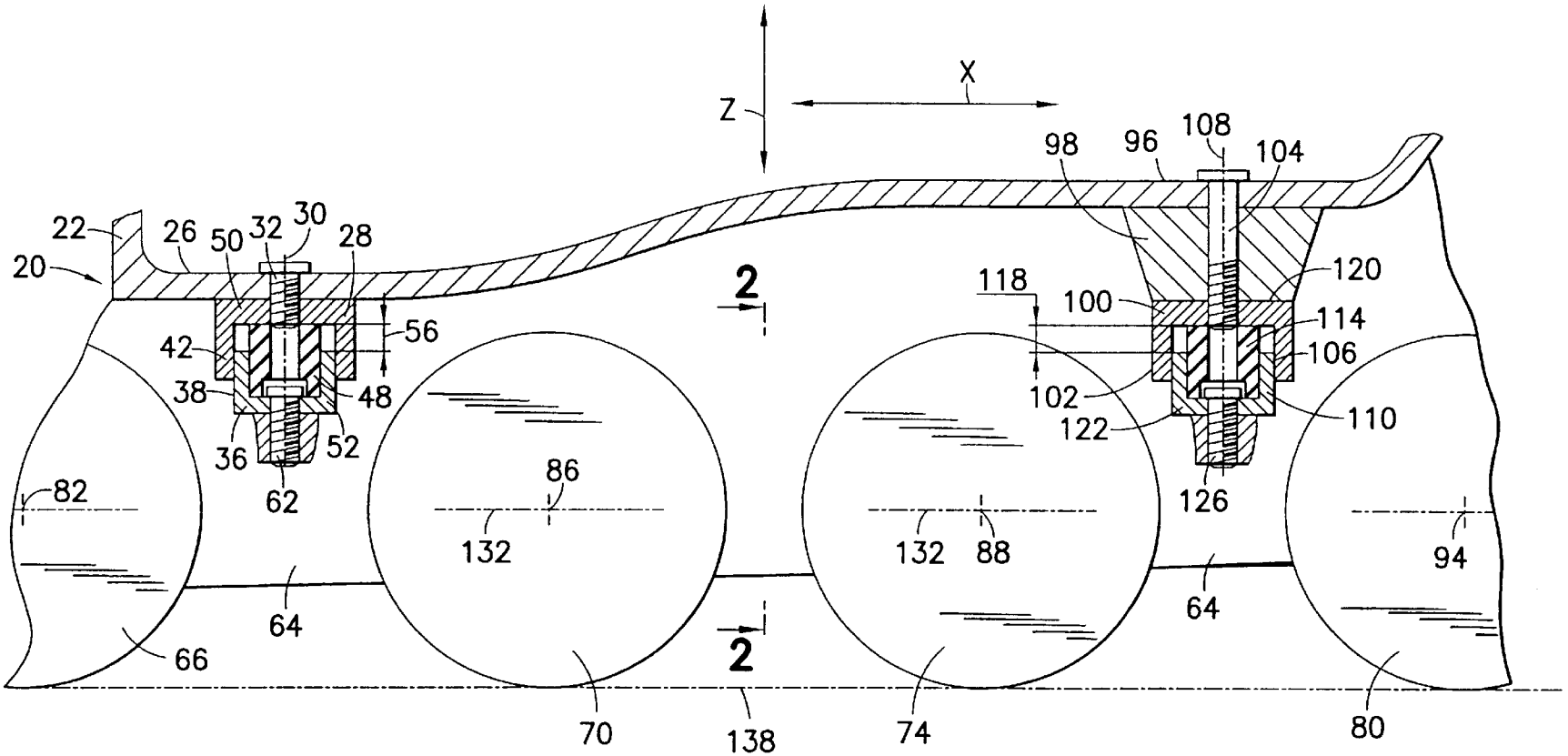
FIG. 1 is a schematic side view of a skate of the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
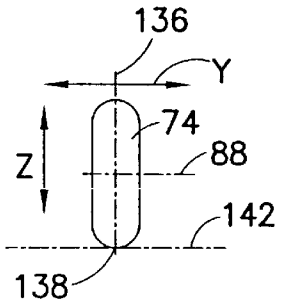
FIG. 2 is a schematic front view of a wheel of FIG. 1 viewed along 2—2.

Referring to FIGS. 1 and 2, in-line skate 20 has platform 22 which is adapted for attachment of the skate to a skater's foot. The means for adapting the platform for attachment of the skate to a skater's foot is known to the art, and may include for example straps to hold a shoe, and a shoe in which the platform comprises a sole of the shoe.

Platform 22 is rigidly attached at toe area 26 to cup 28 by screw 32. Cup 36 tubular wall 38 closely fits tubular wall 42 of cup 28. Preferably cups 28 and 36 are made of metal or strong, stiff plastic or composite.

Tubular walls 38 and 42 are in such close telescopic fit that they essentially prevent lateral differential movement between the cups so that the axis of the cups stay parallel.

Preferably the cups are concentric on axis 30.

Preferably the tubular walls are cylindrical.

Elastic element 48 provides and maintains a resilient extension 56 between cups 28 and 36, supporting base 50 on base 52.

Cup 36 is rigidly attached by screw 62 to rigid frame 64 which contains bearings for wheels 66, 70, 74, and 80, which have respective axis of rotation 82, 86, 88, and 94. The wheel bearings are preferably rigidly mounted on frame 64.

Axes of rotation 82, 86, 88, and 94 are parallel to one another in plane 132. The wheels have the same plane of rotation 136 which is coplanar with wheel 74, and roll on the same ground contact line 138 of the wheels which ride on ground 142.

Platform 22 is rigidly attached at heel area 96 to rigid heel block 98 and to cup 100 by screw 104. Cup 100 tubular wall 102 closely fits tubular wall 106 of cup 110. Cups 100 and 110 are preferably made of metal or stiff plastic or composite. Rigid heel block 98 does not need to be included in a skate of the invention.

Tubular walls 102 and 106 are in such close telescopic fit discussed later herein, that they essentially prevent lateral differential movement between the cups so that the axis of the cups stay parallel.

Preferably the cups are concentric on axis 108.

Preferably the tubular walls are cylindrical.

Elastic element 114 provides and maintains a resilient extension 118 between cups 100 and 110, supporting base 120 on base 122.

Cup 110 is rigidly attached by screw 126 to frame 64.

Figure 3:
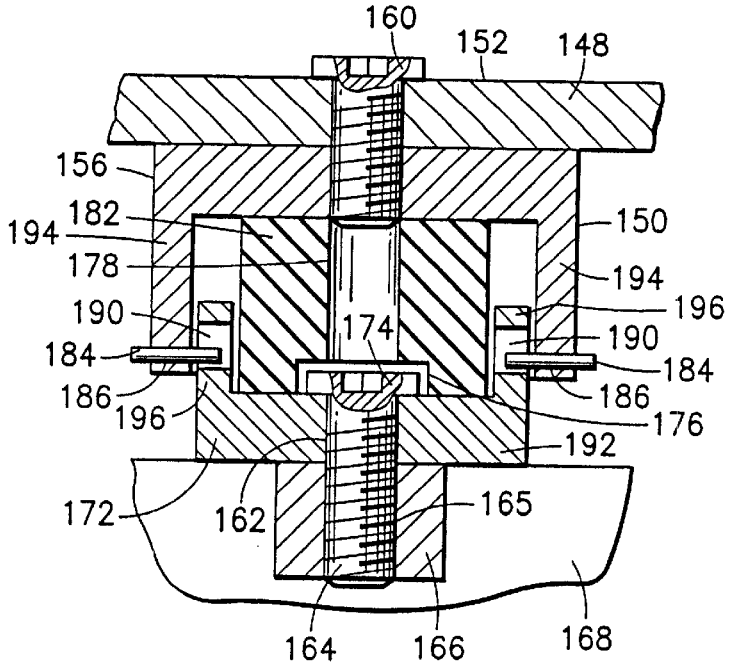
FIG. 3 is a schematic cross section front view of a shock element cartridge mounted in a portion of a skate of the invention taken along 3—3 of FIG. 4.
Figure 4:
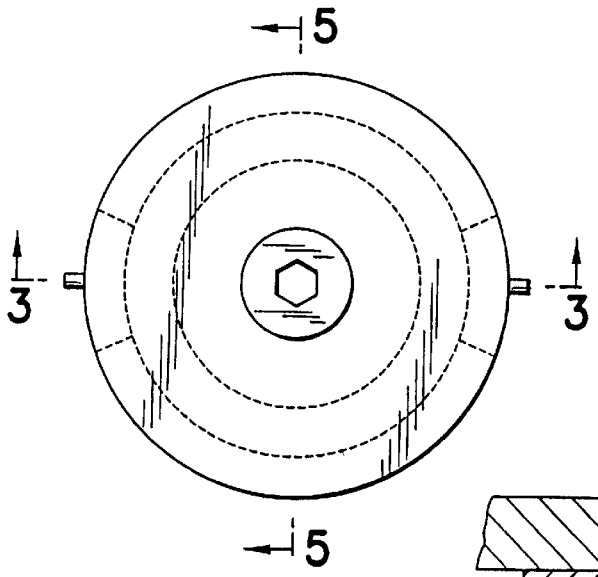
FIG. 4 is a top view of the shock element cartridge of FIG. 3.
Figure 5:
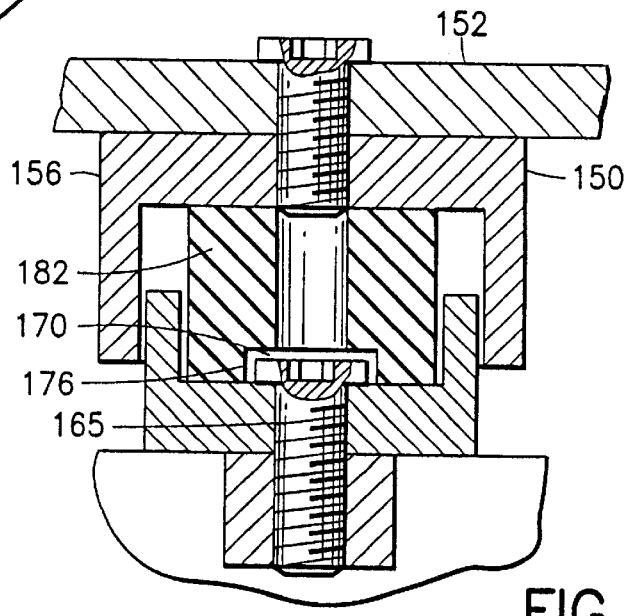
FIG. 5 is a schematic cross section side view of the shock element cartridge of FIG. 3 taken along 5—5 of FIG. 4.

Referring to FIGS. 3, 4, and 5, in another in-line skate of the invention, platform 148 that is adapted for attachment of the skate to a skater's foot is attached to two of shock element cartridge 150, one cartridge at the front of the platform near the toe area 152 of the platform, and one cartridge at the heel area of the platform which is not shown. As the front and back cartridges are the same, only the front one will now be described.

The shock element cartridge absorbs and releases energy only in the vertical direction, that is, normal to frame 168. The wheels of the skate are rigidly mounted on frame 168 so that they are free to rotate on their axis. The wheels are not shown. The precision cups are close fitting guides which restrict yaw, roll and pitch motion between the cups that would compromise directional stability of the skate.

In assembly of the shock element cartridge 150, screw 164 is placed in lower cup 192 into unthreaded screw hole 162. Next low hysteresis elastomer resilient element 182, is placed in the lower cup and is placed in slight compression by squeezing together the cup assembly. One material for example that can be used for the low hysteresis elastic element is a rubber compound.

Low hysteresis in the description of the invention indicates a return with low loss of energy when the resilient element resiles, energy that was received by the resilient element from compression of the resilient element. For example, a low hysteresis material looses less energy in the form of waste heat from internal friction in the compression-relaxation cycle thus returning back more of the energy in a usable form. Thus a high bounce rubber ball is a low hysteresis system.

Two pins 184 are placed in opposite sides of the lower cup and extend from holes 186 in the upper cup into vertical slots 190 in lower cup 192. They prevent separation of the top and bottom cups. Screws may be used instead of pins into slots 190.

Upper cup 156 is fixedly attached to platform 148 by screw 160 after screw 164 through base 172 of lower cup 192 is tightened into threaded 165 portion 166 of frame 168 of the skate.

Screw head 174 is accessed through hole 178 which is threaded in upper cup 156 for screw 160. The lower portion 170 of hole 178 which is through elastomer 182 has a larger diameter 176 to accommodate screw 164 head 174.

Wall 194 closely fits wall 196, preventing roll, pitch, and yaw between platform 148 and threaded portion 166 of bearing frame 168.

The back cartridge 150 which is not shown, also prevents roll, pitch and yaw between platform 148 and a threaded portion, not shown, of frame 168. Frame 168 is made stiff so that it does not introduce roll, yaw, or pitch between the threaded portion to which the shock element cartridge is attached and the axes and plane of rotation of the skates' wheels.

Cartridges 150 are designed so that either the entire shock mount assembly or just the elastomer is replaceable.

Figure 6:
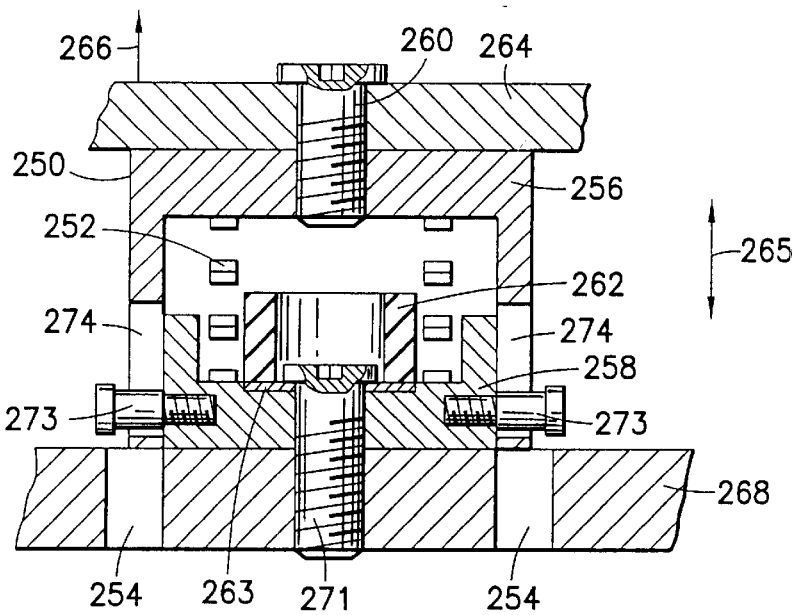
FIG. 6 is a schematic cross section front view of a shock element cartridge mounted in a portion of a skate of the invention taken along 6—6 of FIG. 7.
Figure 7:
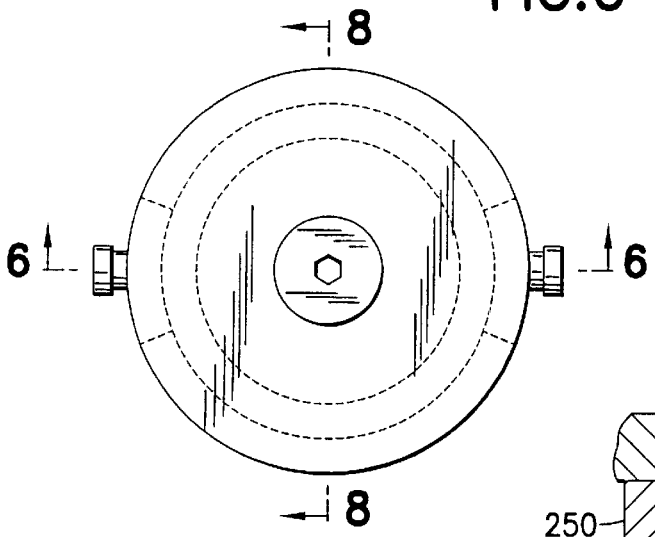
FIG. 7 is a top view of the shock element cartridge of FIG. 6.
Figure 8:
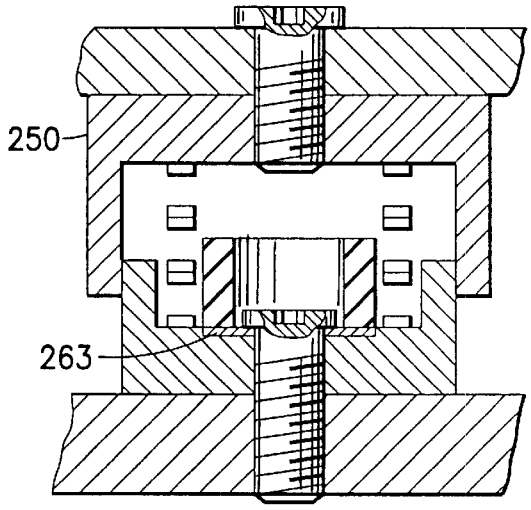
FIG. 8 is a schematic cross section side view of the shock element cartridge of FIG. 6 taken along 8—8 of FIG. 7.

Referring to FIGS. 6, 7, and 8, in-line skate shock element 250 is a replaceable cartridge. Resilient element 252 is a spring. The spring urges rigid cup 256 away from rigid cup 258 in sliding direction 265 which is parallel to sliding relation 266 of cup 256 with cup 258.

Shock element 250 is a low hysteresis resilient system.

A low hysteresis elastomer 262 stop is used to prevent hard contact between the upper cup 256 and lower cup 258. It is held in place by its bond to washer 263 which is captured by lower mount screw 271.

Cup 256 is fixedly mounted on platform 264 by screw 260. Cup 258 is fixedly mounted on frame 268. The wheels of the skate are rigidly mounted on frame 268 so that they are free to rotate on their axis. The wheels are not shown.

Screws 273 through upper cup slots 274 and into the lower cup keep the cup assembly together against the thrust of the spring. Pins may be used instead of screws.

Clearance for the upper cup travel relative to the lower cup is provided by slots 254 in frame 268.

Figure 9:
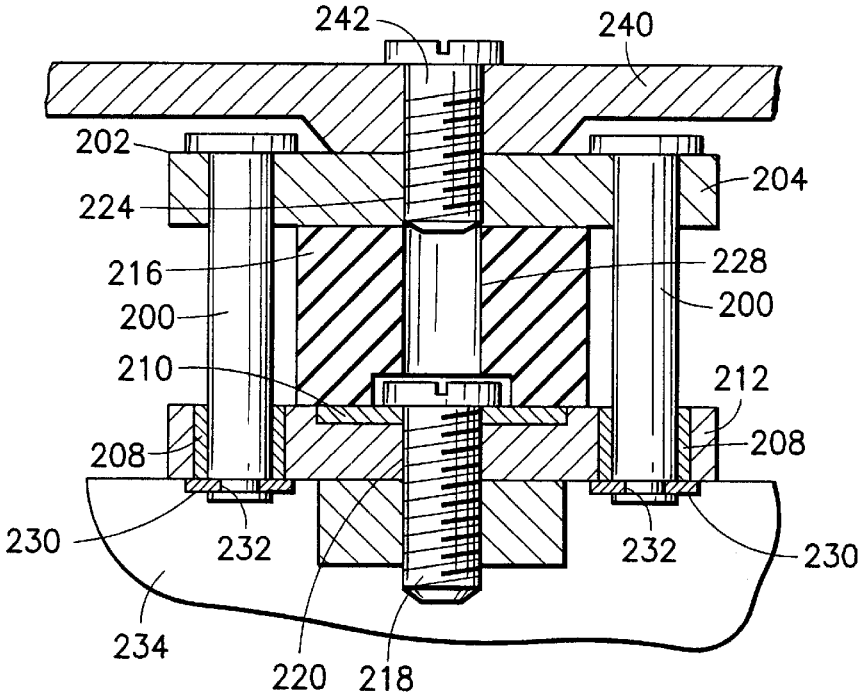
FIG. 9 is a schematic cross section front view of a shock element mounted in a portion of a skate of the invention taken along 9—9 of FIG. 10.
Figure 10:
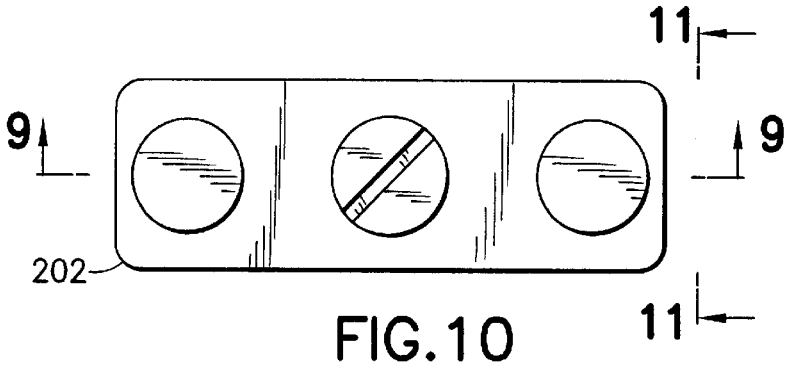
FIG. 10 is a top view of the shock element of FIG. 9.
Figure 11:
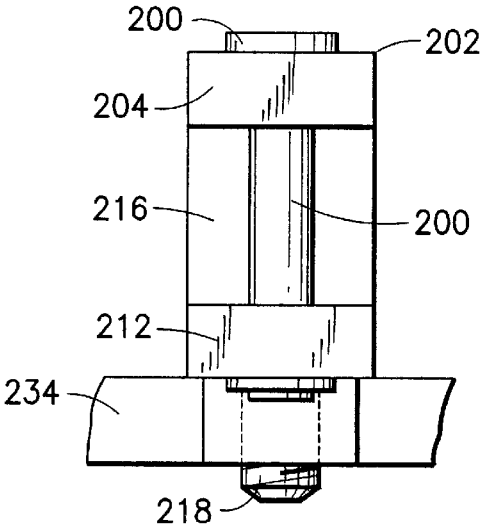
FIG. 11 is a schematic cross section side view of the shock element of FIG. 9 taken along 11—11 of FIG. 10.

Referring to FIGS. 9, 10, and 11, in another in-line skate of the invention, platform 240 that is adapted for attachment of the skate to a skater's foot is attached to two of shock element 202, one at the front of the platform near the toe area of the platform, and one cartridge at the heel area of the platform.

As the front and back shock mount assemblies are the same, only the front one will now be described.

Bars 200 of shock element 202 pass through upper mount plate 204 and are preferably rigidly attached to plate 204. Bars 200 pass through precision bearings 208 which are mounted in lower plate 212. Sandwiched between plates 204 and 212 is low hysteresis elastomer, resilient spacer element 216 that is bonded to plate 210.

Lower mounting screw 218 is enclosed and preferably trapped by resilient element 216 and plate 212.

During assembly, lower mounting screw 218 is placed through plate 210 and lower plate 212 hole 220. Bars 200 which are assembled to upper plate 204 are placed through bearings 208 in plate 212. Elastomer 216 is bonded to plate 210. Retaining rings 230 are placed in machined grooves 232 in bars 200 to insure non separation of bars 200 from lower plate 212 thus preventing the assembly from coming apart.

The elastomer has an appropriate thickness so that when it is enclosed between the two plates and with their extension limited by retaining rings 230, it is preferably in slight compression.

Frame 234, which mounts the wheels of the skate, is rigid so that it will not contribute roll, pitch or yaw.

Shock element 202 is attached to frame 234 via screw 218 in the lower plate which attaches the lower plate rigidly to frame 234.

Access to screw 218 is through the threaded hole 224 in the upper plate and through the vertical hole 228 in the elastomer.

The shock element and frame 234 is then attached to platform 240 using screw 242 that attaches to the threaded hole in the upper plate. Upper plate 204 is rigidly attached to platform 240.

The user has the option of replacing just resilient element 216 and plate 210 or entire shock element 202.

Very small clearances in the bearings between bars 200 and bearing 208 mounted on lower plate 212, and very small clearances between the bars and upper plate 204 prevent roll, pitch, and yaw between plates 204 and 212 and between platform 240 and frame 234 at their respective attachment to plates 204 and 212.

Figure 12:
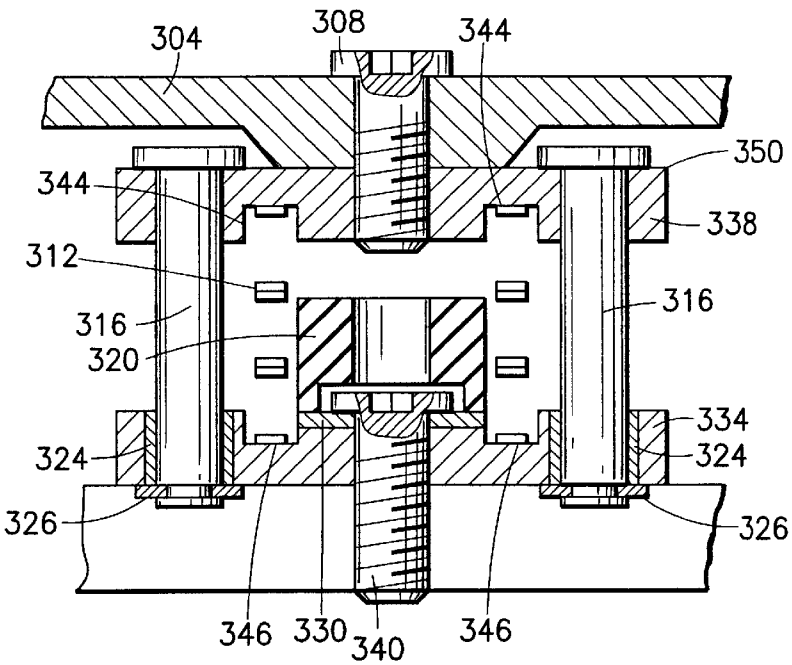
FIG. 12 is a schematic cross section front view of a shock element mounted in a portion of a skate of the invention taken along 12—12 of FIG. 13.
Figure 13:
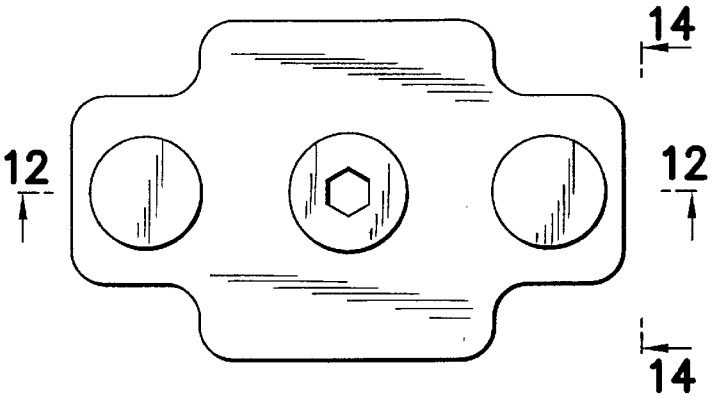
FIG. 13 is a top view of the shock element of FIG. 12.
Figure 14:
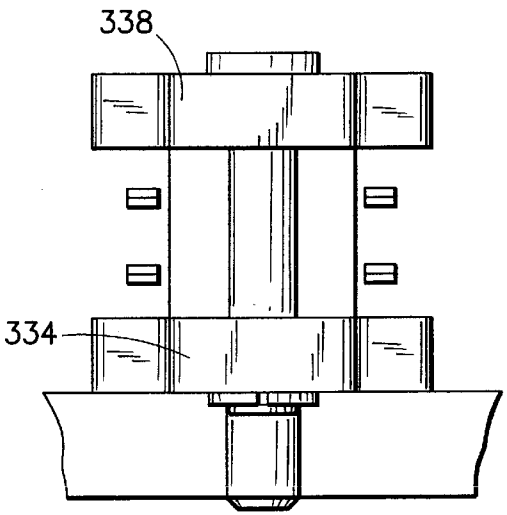
FIG. 14 is a schematic cross section side view of the shock element of FIG. 12 taken along 14—14 of FIG. 13.

Referring to FIGS. 12, 13, and 14, wave spring 312 sits in grooves 344 and 346 machined in the inside faces respectively of upper mounting plate 338 and lower mounting plate 334.

Low hysteresis elastomer stop 320 prevents hard contact between the upper mounting plate and the lower mounting plate. It is bonded to washer 330 which is captured by lower mounting screw 340.

Screw 308 rigidly fastens platform 304 for the user's foot to rigid upper mounting plate. 338. Screw 340 rigidly fastens rigid lower mounting plate to rigid frame 328 which is designed to hold skate wheel bearings.

Platform 304 is preferably flexible locally adjacent to the attachment of the platform to screw 308 so that the platform can flex in pitch. Preferably platform 304 is generally stiff so that it does not twist about the longitudinal axis of the platform.

Rigid guide bars 316 fit tightly in upper mounting plate 338 and can be fastened thereto, and very small clearances between bars 316 and bearings 324 mounted in plate 334 prevent roll, pitch, and yaw between plates 338 and 334 of shock 350 and prevents roll, pitch and yaw between platform 304 and frame 328 at their respective attachment to plates 338 and 334.

Figure 15:
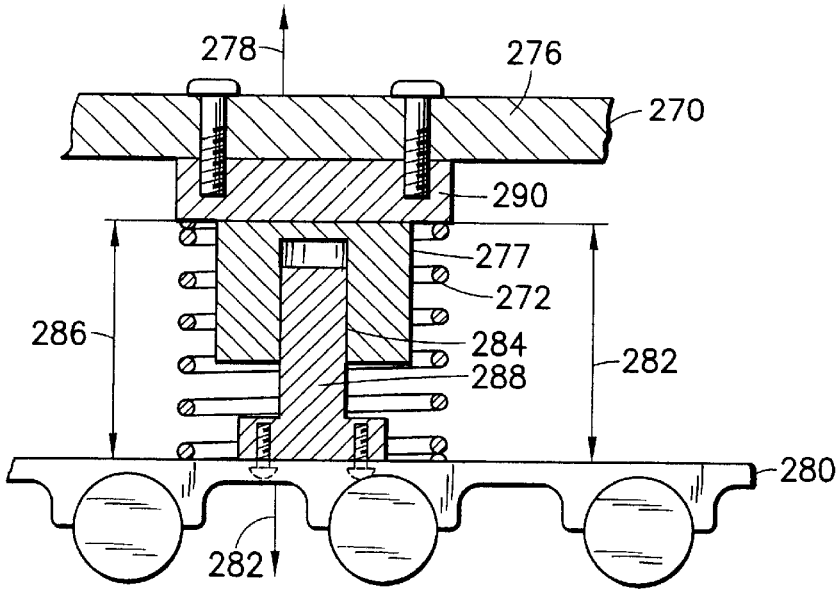
FIG. 15 is a schematic cross section side view of a shock element mounted on a portion of a skate of the invention.

Referring to FIG. 15, in-line skate low hysteresis shock element 270 resilient element 272 is a spring. It urges platform 276 away from 278 rigid wheel bearing frame 280 in sliding direction 282 which is parallel to sliding relation 286 of bearing wall 277 and bearing wall 284 of rigid post 288 that is rigidly mounted on rigid wheel bearing frame 280.

Platform 276 is generally rigid and is locally flexible adjacent to the fixed attachment of the platform to spacer block 290 which is rigidly mounted on bearing wall 277.

Figure 16:
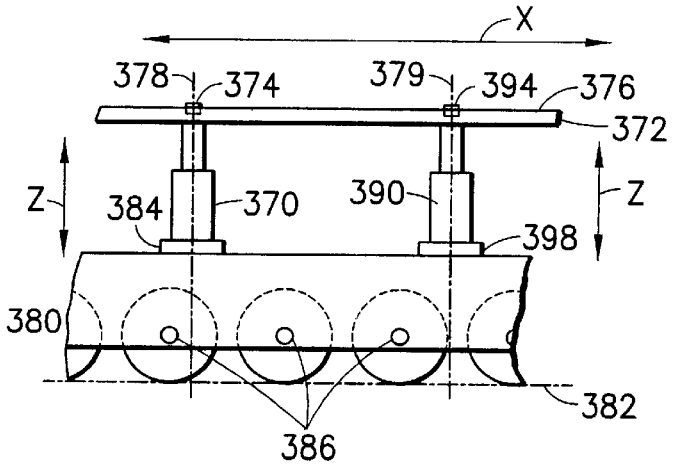
FIG. 16 is a schematic side view of a pair of shock elements mounted on a portion of a skate of the invention.
Figure 17:
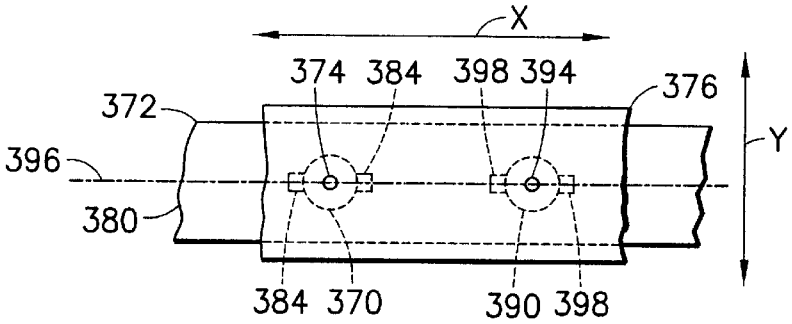
FIG. 17 is a top view of the skate portion of FIG. 16.

Referring to FIGS. 16 and 17, low hysteresis shock element 370 of skate 372 is attached at rigid attachment 374 to foot platform 376 which is locally flexible adjacent to the attachment points 376 and 374 and is otherwise preferably rigid, and element 370 is attached to rigid wheel bearing frame 380 at rigid attachment 384.

Low hysteresis shock element 390 is attached at rigid attachment 394 to foot platform 376, and element 390 is attached to frame 380 at rigid attachment 398.

Attachment 374 moves in the Z direction from attachment 384. Attachment 394 moves in the Z direction from attachment 398. Movements in the Z direction of attachments 374 and 394 are along parallel lines 378, 379. Preferably parallel lines 378 and 379 are normal to ground contact line 382 of the skate's heels.

Attachment 374 is prevented by shock element 370 from movement in the X toe-to-heel and the Y lateral to toe-to-heel directions from attachment 384 and from attachment 394, and from movement in the Y direction from ground contact line 382 of the wheels, and from movement in the X direction from an axis 386 of the wheels.

Attachment 394 is prevented by shock element 390 from movement in the X and Y directions from attachment 398 and from attachment 374, and from movement in the Y direction from ground contact line 382 of the wheels, and from movement in the X direction from an axis 386 of the wheels.

Line 396 through attachments 374, 394 is prevented from yawing from ground contact line 382 of the wheels and from the plane of rotation of the wheels, by shock elements 370 and 390.

Although preferably line 396 coincides with the plane of rotation of the wheels, it should be understood that the above description also applies when the line is not situated in the plane of rotation of the wheels.

When the plane of rotation of the wheels is used as-a reference for describing roll or yaw of an element of the invention from the plane of rotation of the wheels, the term "from" is not used to mean that the element is restricted to being located in the plane of the rotation of the wheels. The element can be located in a plane parallel to the plane of rotation of the wheels. A plane parallel to the plane of rotation by definition includes the plane of rotation.

In operating the invention, for light shock loads, usually encountered in coasting, the flexible platform for the riders foot (foot meaning foot with or without a shoe) tends to remain in position relative to the ground due to the inertia of the skater's leg and body. Thus momentary movement of the wheel bearing frame or carriage in the vertical direction causes the low hysteresis resilient element of elastomer, spring, contained gas, or other resilient material, to compress without transmitting motion to the platform.

For medium shock loads where the wheel bearing frame momentarily pivots resulting in an angle greater than angle f, an angle whose tangent equals the bearing clearance divided by the bearing length of the shock element, the locally flexible foot platform undergoes bending and assumes a momentary shape that allows further compression of the resilient element thus minimizing shock transmission without appreciably changing the pitch of the shoe relative to the ground.

In a power stroke, for light and heavy power strokes, the skater first compresses the resilient elements thus storing energy. The stored energy is released during the stroke and provides an extra power boost. For the average skater, the, deflections in the front and back shock elements are equal and are released at an equal rate.

The present invention, by having the rigidly parallel leg, U configuration of the shock elements and frame, the flexible foot platform attached to the free ends of the legs of the U, very close bearing clearance, resilient spacer qualities, and stiffness of the flexible platform near the mount points to the legs, allows use of the skater's muscles that are used for ankle extension.

The area of the platform near the attachment points is allowed to flex up and down in the in-line axis. Stiffness of the front and back shock elements are different and controlled to match the skater's weight, strength and style.

In an aggressive power downstroke of the skater, both front and rear mounts may be equally compressed.

In an aggressive upstroke when the skater rocks forward the rear mount is released first, as in running, lifting and extending the ankle to obtain the additional power from the muscles in the leg which in conventional in-line skates are not used. The rear and the front resilient elements of low hysteresis elastomer, spring, or other elastic material, provide an extra boost from the stored energy of compression. The design allows an infinite variation to achieve optimum efficiency for racing or street use.

Preferably the platform bends adjacent to the attachment points.

The platform is designed to resist bending about an axis that extends lengthwise with the skate so that the skate does not roll or yaw.

One method of accomplishing unidirectional local bending is to arrange that reinforcement fibers in the platform are in the same direction, normal to the direction that the platform is to bend.

Figure 18:
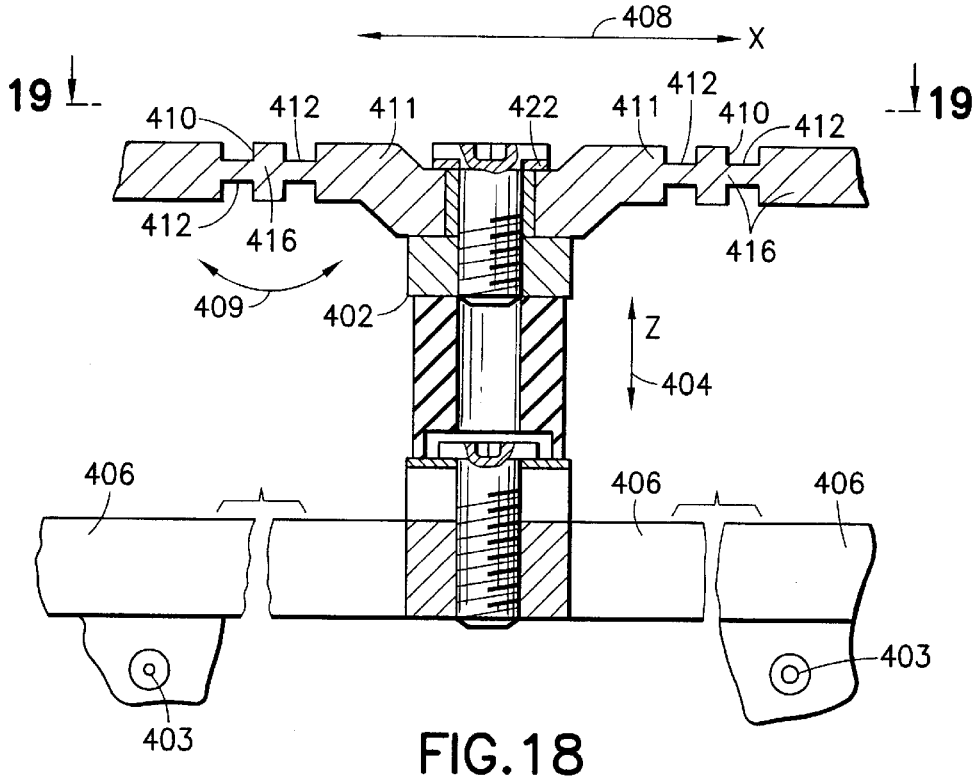
FIG. 18 is a schematic cross section side view of a foot platform, supported by a shock element on a wheel bearing frame of a skate of the invention.
Figure 19:
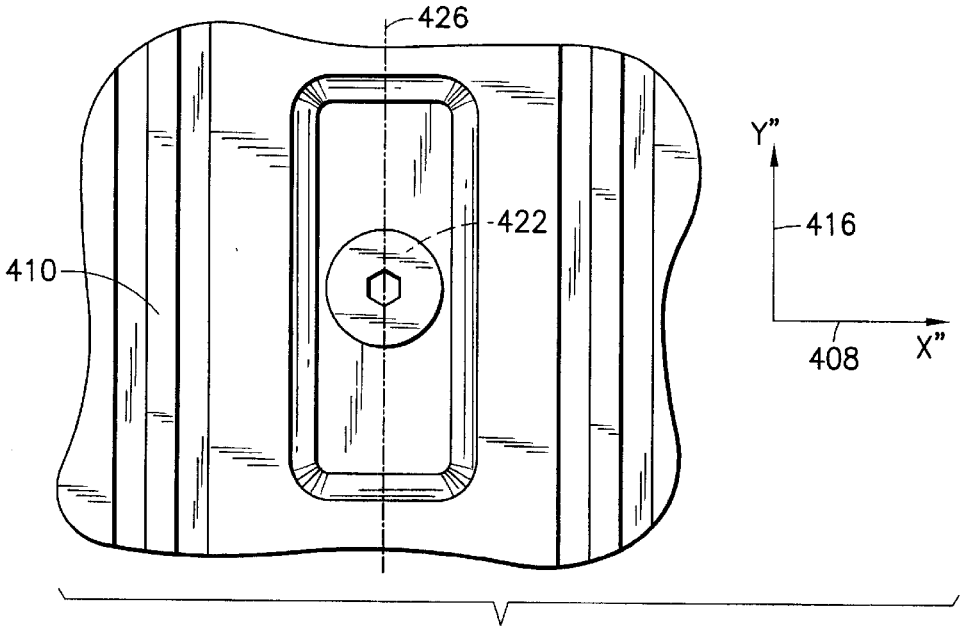
FIG. 19 is a top view of the foot platform of FIG. 18.

Another method is shown in FIGS. 18 and 19. Shock element 402 which is attached to rigid frame 406 moves in the Z direction 404. Frame 406 is rigidly attached to skate wheel bearings 403.

Flexing 409 of platform 411 in a pitch direction takes place around the Y direction 416, that is around an axis that is generally normal to the longitudinal direction X 408 of the foot, in the area of reduced platform thickness 412 between ribs 410. Roll around the X direction 408 and yaw is prevented by stiffness of the platform against twist around and away from an axis in the X direction. The platform is 27 times stiffer in general than in the area of ribs 410 which are adjacent to the portion sandwiched under metal washer 422.

For medium and heavy power strokes, the skater first compresses the resilient elements thus storing energy. The platform flexes as the skater tries to push off extending the ankle (similar to running) in order to get more speed from the stroke. The platform and elastic material of the resilient elements characteristics can be chosen to match the skaters requirements.

The platform can be designed to flex around a plurality of Y axis spaced along the length or X axis of the platform, with, or instead of, the ribs.

Platform 412 can be made so that it flexes around a Y axis 426 at the attachment of shock element 402 to platform 412 while the attachment of shock element 402 to platform 412 is rigid against flex of the platform around the X axis.

For the experienced skater, the compression in the front and rear shock elements will be equal, however the release of energy is not an equal rate. The rear shock element will be released at a faster rate with the front shock (under the ball of the foot) being last. This allows the experienced skater to get more power from knee and ankle extension.

Figure skaters on ice skates can push off with their front toe resulting in effective power due to the front teeth in the blade. Roller skaters, especially those in-line rollers have to use the entire blade. Push off occurs with the reaction point of ground to skate contact between the vertical center lines of the front and rear wheels and with two of the wheels in contact with the ground. The present invention allows the skater to use the entire leg muscle for a true power stroke. The low hysteresis system equates to power in being approximately equal to power out.

The shock mount element is designed so that the durometers, spring rate of resilient material, wave spring, or other resilient element can be changed. The skater can make the adjustment to the system to match their weight and power stroke distribution.

Figure 20:
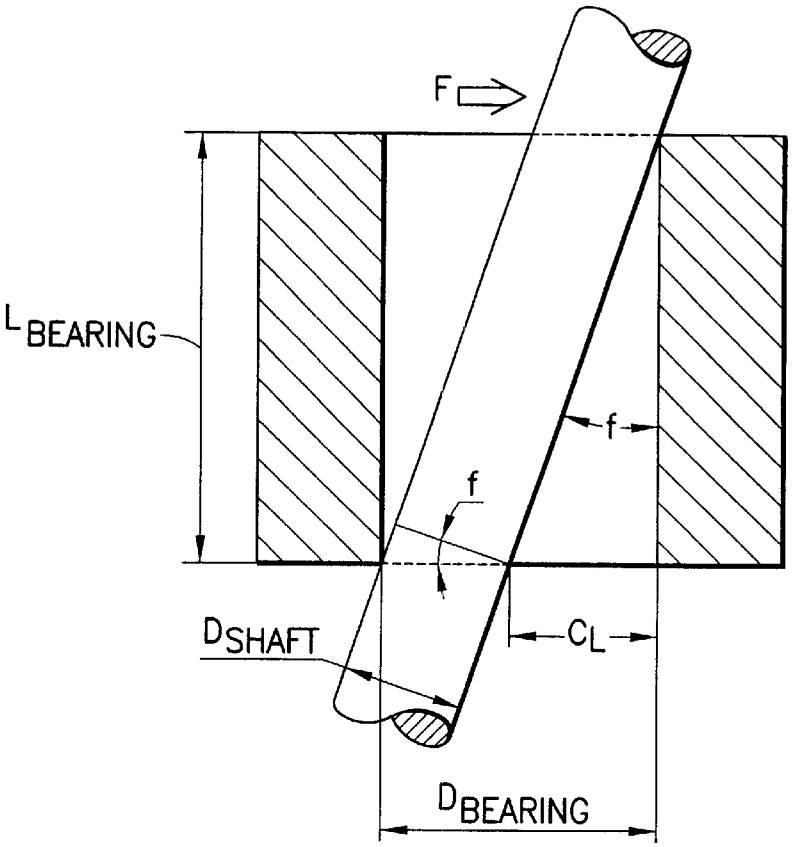
FIG. 20 is a diagram of a bearing exaggerated to show angles and clearances for calculations.
Figure 21:
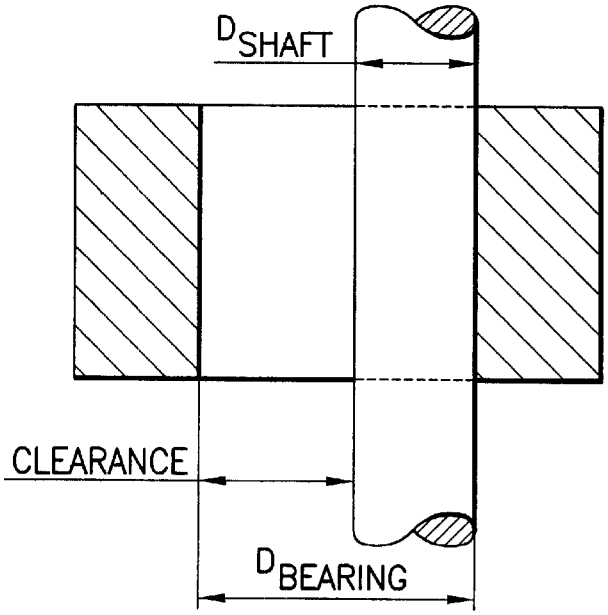
FIG. 21 is a diagram of a bearing exaggerated to show angles and clearances for calculations.

Referring to FIGS. 20 and 21, the bearings of the shock element of the invention have extremely small clearance. where:

F=Side load f=Angle $D_b$=Bearing Diameter $L_b$=Bearing Length $D_s$=Shaft Diameter $$C_L=D_b-D_s/\text{Cos } f \quad (1)$$

$$C_L=(\text{Tan } f)(L_B) \quad (2)$$

Side loads determine the requirements for minimum diameter of the shaft minimum required bearing area and corresponding bearing length $C_L$ then determines angle f by the trigonometric relationship $$f=\text{Tan}^{-1}\, C_L/L_B \quad (3)$$

However, $$\text{Clearance}=D_B-D_S \quad (4)$$

For small angles (e.g. 1 degree) Sin f=Tan f

Or Clearance=$C_L$

Therefore, angle f equals the angle whose tangent is equal to the clearance/bearing length.

The shaft diameter and bearing length are optimized for minimizing angle f (which controls roll, pitch and yaw). This is done by minimizing bearing clearance.

The ideal bearing solution to minimize pitch, roll and yaw results in angle f=0°.

Tolerance of dimension plays an important part in controlling the angle where angle f is less than 1°. Maximum clearance results when the bearing diameter is at a maximum and the shaft is at a minimum.

For sleeve bearings, the difference between maximum and minimum clearance is typically 0.0007 in resulting in angle f of 0.7° maximum and 0.5° minimum.

For sleeve linear slide bearings, as the clearance decreases, thus reducing angle f, the tendency for the slide to jam becomes more pronounced. Therefore, particular attention must be made to bearing design and reducing the coefficient of friction by design and choice of material of shaft and sleeve.

Use of linear ball bearings to reduce sliding friction of the rigid sliding elements of the shock element can be a solution to the objective of minimizing angle f and the tendency to jam. This however is at the expense of having to use larger linear ball bearings to obtain the same load rating as the sleeve bearings.

Figure 22:
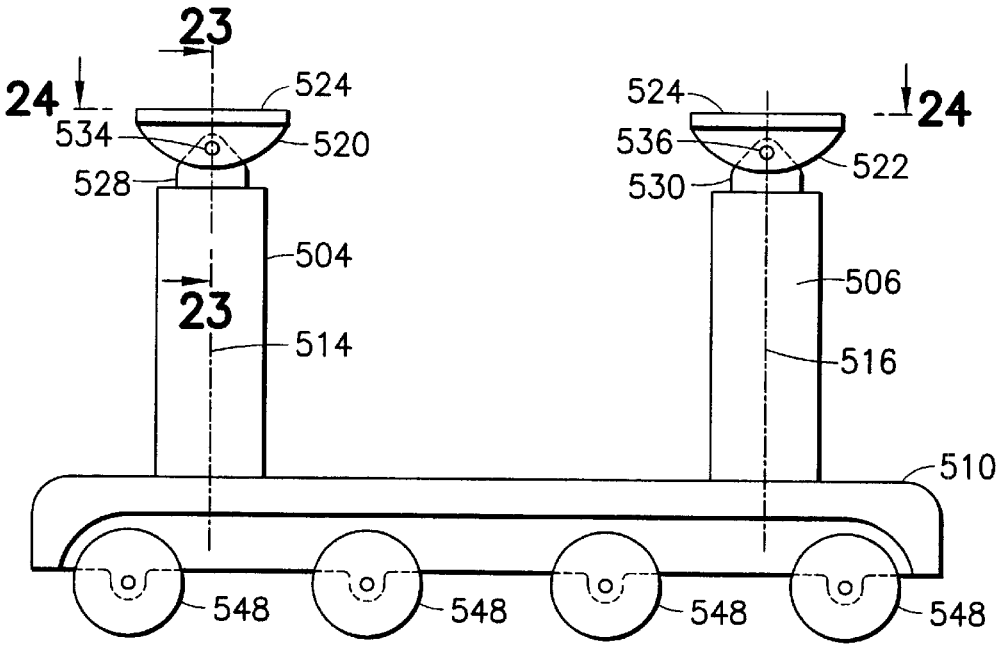
FIG. 22 is a schematic side view of a skate of the invention.
Figure 24:
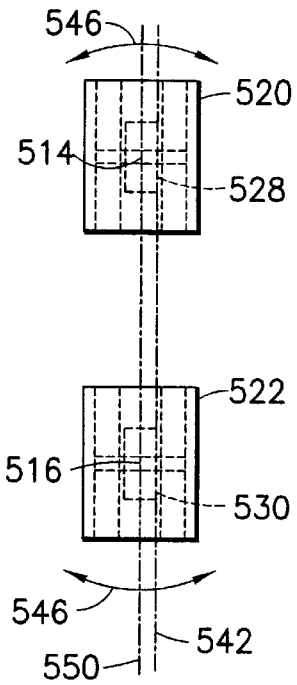
FIG. 24 is a schematic top partial view of the skate of FIG. 22.
Figure 23:
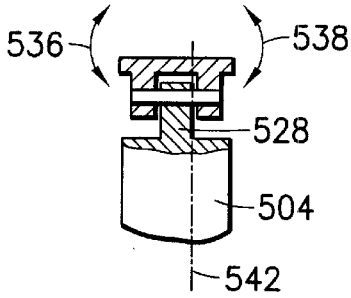
FIG. 23 is a schematic side partial view of the skate of FIG. 22.

Referring to FIGS. 22–24, shock elements 504 and 506 are rigidly mounted on rigid frame 510 so that axis of extension 514 and 516 of platform attachment brackets 520 and 522 from frame 510 are fixed at parallel.

Attachment brackets 520 and 522 are designed to attach to a platform for a shoe or to a shoe. This can be done by glue 524, screws or other fastening means.

Pivot bracket 528 and pivot pin 534 prevent attachment bracket 520 from rolling 538 from the plane of rotation 542 of in-line wheels 548 which are mounted on frame 510.

Preferably also pivot bracket 530 and pivot pin 536 prevent attachment bracket 522 from rolling from the plane of rotation 542 of in-line wheels 548.

Pivot brackets 528 and 530 prevent yaw 546 of brackets 520 and 522, and yaw 546 of a line 550 through the centers of the attachment brackets from the plane of rotation 542 of in-line wheels 548.

It should be understood that the above description also applies when the pivot brackets and or line 550 are not situated or located in the plane of rotation 542.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

DRAWING DESIGNATORS (INFORMAL)

20 in-line skate
22 platform, adapted for attachment of skate to a foot
26 toe area of platform 22
28 cup
30 axis
32 screw
36 cup
38 tubular wall of cup 36
42 tubular wall of cup 28
48 elastic element
50 base of cup 28
52 base of cup 36
56 extension
62 screw
64 frame
66 wheel
70 wheel
78 wheel
80 wheel
82 axis of rotation
86 axis of rotation
88 axis of rotation
94 axis of rotation
96 heel area
98 heel block
100 cup
102 cylindrical wall
104 screw
106 cylindrical wall
108 axis
110 cup
114 elastic element
118 extension, distance
120 base
122 base
126 screw
132 horizontal plane
136 plane of rotation
138 ground contact line
148 platform
150 shock element cartridge
152 toe area
156 upper cup
160 screw
162 hole, unthreaded
164 screw
165 thread
166 threaded portion
168 bearing frame
170 lower portion of hole 178
172 base of lower cup
174 screw head
176 diameter
178 hole
182 resilient element
184 pin
186 hole, threaded
190 slot
192 lower cup
194 wall
196 wall
200 bar
202 shock element
204 upper plate
208 precision bearings
210 plate
212 lower plate
216 resilient element
218 lower mounting screw
220 hole
224 threaded hole
228 vertical hole
230 retaining ring
232 groove
234 frame
240 platform
242 screw
250 shock element
252 resilient element
254 slot
256 cup
258 cup
260 screw
262 low hysteresis elastomer
263 washer
264 platform
265 sliding direction
266 sliding relation
268 frame
270 shock element
271 screw
272 resilient element, spring
273 screw
274 slot
276 platform
277 bearing wall
278 direction arrow, away from
280 frame
282 sliding direction
284 bearing wall
286 sliding relation
288 post, rigid
290 spacer block
304 shoe platform
308 screw
312 wave spring
316 guide bar
320 stop
324 bearing
326 snap ring
328 frame
330 washer
334 lower mounting plate
338 upper mounting plate
340 lower mounting screw
344 groove
346 groove
350 shock
370 shock element
372 skate
374 attachment
376 foot platform
378 line
379 line
380 frame
382 ground contact line of the wheels
384 attachment
386 axis of wheels
390 shock element
394 attachment
396 line
398 attachment
402 shock element

403 skate wheel bearing
404 direction, Z
406 wheel bearing frame
408 direction, X
409 flex
410 ribs
411 platform
412 reduced thickness of platform
416 direction, Y
422 washer
426 attachment
504 shock element
506 shock element
510 rigid frame
514 axis of extension
516 axis of extension
520 bracket
522 bracket
524 glue
528 pivot bracket
530 pivot bracket
534 pivot pin
536 pivot pin
538 rolling, arrow
542 plane of rotation of wheels
546 yaw, arrow
548 wheel
550 line

What is claimed is:

1. An in-line skate comprising:

a platform adapted for attachment of the skate to a foot, a rigid frame, a plurality of wheels mounted on said frame, configured for rolling ground contact along a single line, each wheel of said plurality of wheels having an axis of rotation, said plurality of wheels having a plane of rotation that is coplanar with at least one of the wheels, a first shock element mounted on said platform and said frame configured for non-pivotal resilient extension of said platform from said frame along a first axis only, said first shock element comprising a first bearing element mounted on said platform and a second bearing element mounted slidably on said first bearing element and moveable thereon in said first axis only and mounted rigidly on said frame in fixed, non-pivotal position to the axis of rotation and to the plane of rotation of said plurality of wheels, said first shock element comprising a resilient element that urges said first bearing element slidingly away from said second bearing element in said first axis only, said platform having a toe area and a heel area, and further comprising a second shock element, said first shock element being in one of said toe area and said heel area, said second shock element being in the other of said toe area and said heel area, said second shock element being mounted on said platform and being mounted on said frame in fixed position to the axes of rotation and to the plane of rotation of said plurality of wheels.

2. The skate of claim 1, wherein said second shock element is configured for resilient extension of said platform from said frame along a second axis parallel to said first axis.

3. The skate of claim 2, wherein said platform is adapted to change pitch between said first shock element and said second shock element.

4. The skate of claim 1, wherein said platform is flexible in pitch, and is stiff against yaw and roll from a plane parallel to the plane of rotation of said plurality of wheels.

5. The skate of claim 1, wherein said platform is flexible in pitch, and is rigid against yaw and roll from a plane parallel to the plane of rotation of said plurality of wheels.

6. An in-line skate as defined by claim 1, wherein the first bearing element and the second bearing element are linear slide bearings.

7. An in-line skate as defined by claim 6, wherein each of the first and second bearing elements is a cup-shaped element, and wherein one of the first and second cup-shaped bearing elements is closely received by the other of the first and second cup-shaped bearing elements, each of the first and second cup-shaped bearing elements having tubular walls which are in close telescopic fit such that the walls essentially prevent lateral differential movement between the first and second cup-shaped bearing elements and so that the longitudinal axis of the first and second cup-shaped bearing elements remain parallel to each other.

8. An in-line skate as defined by claim 4, wherein at least one of the first and second cup-shaped elements includes one of a pin and a screw mounted on the tubular wall thereof, and wherein the other of the first and second cup-shaped bearing elements includes an elongated slot formed in the tubular wall thereof, the slot and the one of the pin and the screw being aligned such that the one of the pin and the screw is received in the slot to prevent the separation of the first and second cup-shaped bearing elements from each other.

9. An in-line skate as defined by claim 6, wherein one of the first bearing element and the second bearing element includes a pair of spaced apart bars, and wherein the other of the first bearing element and the second bearing element includes a pair of spaced apart precision linear bearings, each bar being aligned with and closely received by a respective precision linear bearing with very small clearances therebetween, the very small clearances between the bars and the precision linear bearings substantially preventing roll, pitch and yaw between the platform and the frame; and wherein the in-line skate further includes a resilient element positioned between the pair of bars.

10. An in-line skate as defined by claim 9, wherein the resilient element includes a spring and an elastomeric stop situated inside the spring.

11. An in-line skate as defined by claim 6, wherein one of the first bearing element and the second bearing element includes a post having a bearing wall and the other of the first bearing element and the second bearing element includes a slide bearing having a bearing wall, the slide bearing closely slideably receiving the post; and wherein the in-line skate includes a resilient element, the post and slide bearing being situated within the resilient element, the resilient element urging the platform away from the frame in a sliding direction which is parallel to the sliding relation of the bearing wall of the post and the bearing wall of the slide bearing.

12. An in-line skate comprising:

a platform adapted for attachment of the skate to a foot, a frame, a plurality of in-line wheels mounted on said frame, said plurality of in-line wheels having a plane of rotation that is coplanar with at least one of the wheels, a first shock element comprising a first bearing element configured for solely a Z direction movement of said first shock element along an axial direction of said first shock element, mounted on said frame and on said platform, a second shock element comprising a second bearing element configured for solely a Z direction movement of said second shock element along an axial direction of said second shock element, mounted on said frame and on said platform, spaced from said first shock element, the shock elements being configured so that said platform is moved non-pivotally and solely in a Z direction by each shock element.

13. The skate of claim 12, wherein said platform is configured to change pitch between said first shock element and said second shock element.

14. The skate of claim 12 wherein said platform is flexible in pitch, and is stiffened against yaw and roll from a plane parallel to the plane of rotation of said plurality of inline wheels.

15. The skate of claim 12 wherein said platform is flexible in pitch, and is rigid against yaw and roll from a plane parallel to the plane of rotation of said plurality of in-line wheels.

16. The skate of claim 12 wherein the shock elements at their mountings to said platform are prevented from moving in an X or Y direction from each other, from moving in a Y direction from a plane parallel to the plane of rotation of said plurality of in-line wheels, and from moving in the X direction from a line parallel to the axis of rotation of at least one of the wheels of said plurality of in-line wheels.

17. The skate of claim 12 wherein the shock elements at their mountings to said frame are prevented from moving in an X or Y direction from each other, from moving in a Y direction from a plane parallel to the plane of rotation of said plurality of in-line wheels, and from moving in the X direction from a line parallel to the axis of rotation of at least one of the wheels of said plurality of in-line wheels.

18. The skate of claim 16 wherein the shock elements at their mountings to said frame are prevented from moving in an X or Y direction from each other, from moving in a Y direction from a plane parallel to the plane of rotation of said plurality of in-line wheels, and from moving in the X direction from a line parallel to the axis of rotation of at least one of the wheels of said plurality of in-line wheels.

19. The skate of claim 16 wherein said platform is flexible in pitch, and is stiff against yaw and roll from a plane parallel to the plane of rotation of said plurality of in-line wheels.

20. An in-line skate comprising:

a platform adapted for attachment of the skate to a foot, a frame, a plurality of in-line wheels mounted on said frame and arranged in an X direction, having a ground contact line, a pair of shock elements mounted spaced apart on said frame and mounted on said platform, so that if the wheels are held fixed to the ground, the shock elements are configured so that said platform moves non-pivotally in only a vertical Z direction at each shock element and each shock element is prevented from moving in a lateral Y direction and in a toe to heel X direction from each other.

21. The in-line skate of claim 20 wherein each shock element is prevented from moving in a lateral Y direction from a plane parallel to the plane of rotation of said plurality of in-line wheels that is coplanar with at least one of the wheels, and from moving in the toe to heel X direction measured from a line parallel to the axis of rotation of at least one of the wheels of said plurality of in-line wheels.

22. An in-line skate comprising:

a frame, a plurality of in-line wheels mounted on said frame, having a ground contact line, first shock element mounted on said frame, comprising first means for attaching said first shock element to a platform adapted for attachment of a skate to a foot, a low hysteresis resilient element mounted on said first shock element between the frame and said first means for attaching, for delivering a rebound energy to the platform when said first shock element is attached to the platform, a second shock element mounted on said frame, comprising second means for attaching said second shock element to the platform, said first shock element and said second shock element being configured so that the first and the second means for attaching move non-pivotally and solely in a Z direction, are prevented from moving in a Y direction from a plane parallel to the plane of rotation of said plurality of in-line wheels that is coplanar with at least one of the wheels, and from moving in an X direction from a line parallel to the axis of rotation of at least one of the wheels of said plurality of in-line wheels.

23. In an in-line skate comprising a platform adapted for attachment of the skate to a foot, a frame, a plurality of wheels mounted non-pivotally on said frame, each wheel of said plurality of wheels having an axis of rotation, said plurality of wheels having a plane of rotation that is coplanar with at least one of wheels, the improvement comprising:

shock elements mounted on said platform and said frame and configured for resilient extension of said platform from said frame along individual shock element axes, said shock element axes being directed in a Z direction to allow the frame to move non-pivotally and solely in the Z direction with respect to the platform, each shock element comprising a first bearing clement mounted on said platform and a second bearing element mounted slidably in solely the Z direction on said first being element and mounted rigidly on said frame in fixed position to the axis of rotation and to the plane of rotation of said plurality of wheels, said shock elements being spaced apart so that they support said platform on spaced element axes.

24. In an in-line skate comprising a platform adapted for attachment of the skate to a foot, a frame, a plurality of wheels mounted on said frame, each wheel of said plurality of wheels having an axis of rotation, said plurality of wheels having a plane of rotation that is coplanar with at least one of the wheels, the improvement comprising:

shock elements mounted on said platform and said frame and configured for resilient extension of said platform from said frame along individual shock element axes, each shock element comprising a first bearing element mounted on said platform and a second bearing element mounted slidably on said first bearing element and mounted rigidly on said frame in fixed position to the axis of rotation and to the plane of rotation of said plurality of wheels, said shock elements being spaced apart so that they support said platform on spaced element axes, means on said shock element for preventing separation of said first bearing element from said second bearing element when said shock element is not mounted on said platform and frame so that said shock element is a self-contained element for mounting on said platform and said frame.

* * * * *